United States Patent [19]

Adachi

[11] Patent Number: 4,468,274

[45] Date of Patent: Aug. 28, 1984

[54] METHOD AND APPARATUS FOR BONDING THERMOSENSITIVE ADHESIVE LABEL

[75] Inventor: Takato Adachi, Asaka, Japan

[73] Assignee: E.D.M. Corporation, Tokyo, Japan

[21] Appl. No.: 399,417

[22] Filed: Jul. 19, 1982

[30] Foreign Application Priority Data

| | | | |
|---|---|---|---|
| Jul. 31, 1981 | [JP] | Japan | 56-113932[U] |
| May 25, 1982 | [JP] | Japan | 57-076606[U] |
| May 25, 1982 | [JP] | Japan | 57-076607[U] |
| May 25, 1982 | [JP] | Japan | 57-088286 |

[51] Int. Cl.[3] ..... B65C 9/08; B65C 9/25

[52] U.S. Cl. ..... 156/320; 198/952; 219/10.69; 156/322; 156/499; 156/566; 156/DIG. 21; 156/DIG. 36

[58] Field of Search ..... 198/952; 219/10.69; 156/320, 322, 362, 499, 566, 568, DIG. 21, DIG. 36

[56] References Cited

U.S. PATENT DOCUMENTS

| | | | |
|---|---|---|---|
| Re. 23,828 | 5/1954 | Von Hofe | 156/DIG. 36 X |
| 4,253,896 | 3/1981 | Appleyard et al. | 156/231 |

*Primary Examiner*—Robert A. Dawson

*Attorney, Agent, or Firm*—Kalish & Gilster

[57] ABSTRACT

A method of bonding a label having a thermosensitive adhesive provided on the under surface thereof which comprises providing a label from a supply roll, severing same therefrom and delivering such to a heat transferrable conveyor, providing heat to said conveyor, both during travel and interruptions thereof, for rendering said label tacky, peelingly removing said tackified label from said conveyor in timed relation to an article or object traveling thereby for disposition thereon. Apparatus for accomplishing the series of operations in the above-described method for rendering a thermosensitive adhesive equipped label tacky and automatically applying same to the object to be labeled.

15 Claims, 12 Drawing Figures

METHOD AND APPARATUS FOR BONDING THERMOSENSITIVE ADHESIVE LABEL

BACKGROUND AND SUMMARY OF THE INVENTION

This invention relates to a method of, and apparatus for, bonding a thermosensitive label to an object article to be labelled, the thermosensitive adhesive label being equipped on its back with a thermosensitive adhesive which exhibits tackiness upon heating and retains such for an extended period of time.

Conventional labels in general are coated with an adhesive which is constantly tacky, are then bonded to a peelable separate paper and are shaped in the form of a sheet or roll. The labels are peeled off from the separate paper one by one and bonded to object articles to be labelled. According to this method, however, the separate paper serves only as a bonding means, has no commercial utility, and is uneconomical because it increases the production cost of the label. Since the separate paper has a thickness which is equal to, or greater than, the thickness of the label, the label becomes bulky as a whole and is more difficult to handle. Moreover, the separate paper must be discarded in vain.

Thermosensitive adhesive labels have been proposed as labels which do not use the separate paper and solve the above-mentioned problems. However, because no separate paper is used, the label as a single sheet is difficult to hold or heat. A conventional mechanical method of bonding the label is illustrated in FIG. 1. A paper roll having the same width as an intended label is used as a label element 1. A desired length is fed out by a feed roller 3 upon the instruction of a detector 2 and is cut by a cutter 4. Thereafter, while the label is drawn and held on a vacuum drum 6 with the thermosensitive adhesive 9 facing upward, the label is passed in front of a heater 5 disposed adjacent to the vacuum drum 6. After the thermosensitive adhesive 9 becomes tacky upon heating by the heater 5, the label is bonded to an object article 8 to be labelled that is being conveyed by a conveyor belt 7.

However, in accordance with this method, the label 9 cut by the cutter 4 is heated by the heater 5 while it is held on the vacuum drum 6, so that a complicated mechanism is necessary to prevent the label 9 from falling off the vacuum drum 6. Moreover, the subsequent operation of bonding the label 9 to the object article 8 would be out of balance unless this suction and hold operation is well controlled, making this method difficult to practice. This method has another problem in that since the heater 5 for the thermosensitive adhesive 9' usually uses radiation heat, the heat efficiency is low and hence, a large capacity heat source must be used.

The present invention is primarily directed to eliminate these problems with the prior art. It is a first characterizing feature of the present invention that after the label cut to a desired length is placed on a heat-transferable conveyor belt which is being heated, the thermosensitive adhesive of the label is heated via the aforesaid conveyor belt so as to cause its tackiness and the label is then peeled off from the said conveyor belt by means of an acute turn and is thereafter bonded to the object article to be labelled.

It is a second characterizing feature of the present invention that in place of a system which directly heats the heat-transferable conveyor belt, heating means such as heaters are disposed on a travelling path of a conveyor belt which is resistant to degradation by heat for conveying the thermosensitive adhesive labels in order to simultaneously heat the thermosensitive adhesive labels and the conveyor belt.

It is an object of the present invention to provide both a novel and useful method and apparatus for labelling by the use of a thermosensitive adhesive label, and specifically the type of labels which do not use separate paper backing, but are instead coated on the back with a thermosensitive adhesive exhibiting tackiness upon heating; which apparatus and method obviate the use of vacuum devices for handling of the labels; which are reliable and advantageous in use; and which provide substantially greater heat efficiency; and which eliminate other problems of the prior art.

DESCRIPTION OF PRACTICAL EMBODIMENTS

Figure 2:
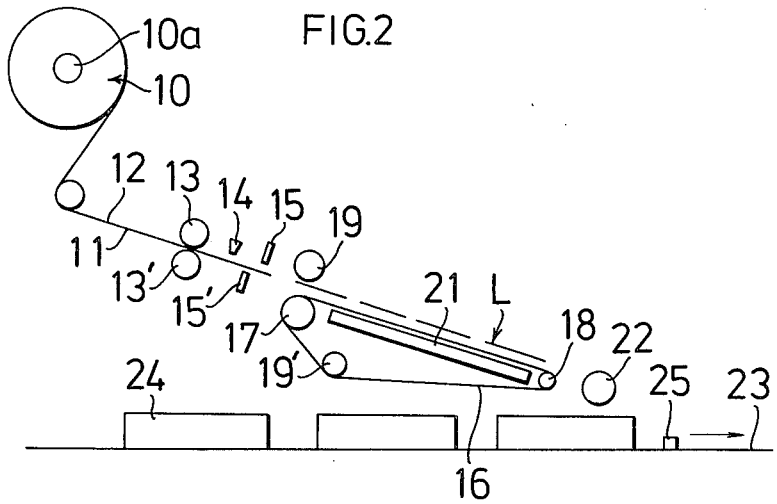
FIG. 2 is a schematic view illustrating apparatus constructed in accordance with and embodying the present invention for bonding thermosensitive labels.
Figure 3:
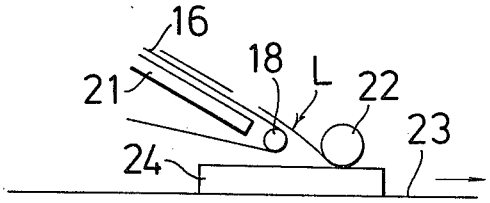
FIG. 3 is an enlarged schematic view of a portion of the apparatus shown in FIG. 2.
Figure 10:
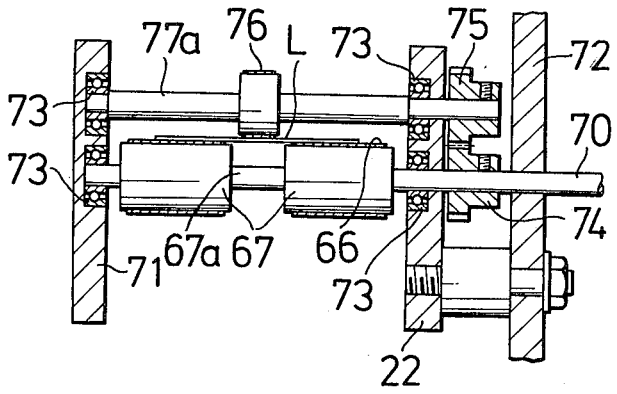
FIG. 10 is a horizontal transverse sectional view taken along the line A—A of FIG. 9.

With reference now being made to FIGS. 2 and 3, 10 designates a paper label element produced as a roll, and a thermosensitive adhesive 11 which is activated upon heating and thereafter keeps its tackiness for an extended period of time even after the heating is removed is coated on the back of the label element by an arbitrary method. Various displays such as the date of production, the production number, the price, the weight, the name of articles, the article number, the mark, the producer, and so forth, are printed in advance on the surface 12 of the label element 10. Alternatively, a printer may be disposed at an intermediate portion of the feeding process of the label element 10 so as to print necessary displays on the surface. Unlike the conventional thermosensitive label using tacky paper, the back of this label element 10 is not tacky under normal conditions and the label element 10 can be handled in the same way as ordinary paper in general. Besides the roll shown in the drawings, the label element 10 may be cut to an arbitrary size and the paper may be ordinary paper or be surface-finished. If the displays are formed by a thermosensitive paint or thermosensitive ink, the thermosensitive adhesive 11 must operate at a lower temperature than the operating temperature of the paint or ink in order to prevent discoloration due to heating.

Reference numerals 13, 13' represent a pair of opposed feed rollers for feeding the paper label element 10. Reference numeral 14 represents a detector which operates the feed rollers 13, 13' in accordance with the instruction of an article detector 25, and feeds the label element 10 and detects its length. Reference numerals 15, 15' represent cooperating cutters which cut the label element to a predetermined length in accordance with the instruction from the detector 14.

Reference numeral 16 represents a heat-transferable as well as heat-resistant conveyor belt which travels on a heater 21 whose function is to heat the back of the label L and make the thermosensitive adhesive 11 exhibit its bonding function. The conveyor belt 16 peels the label L from its trailing end after it is made tacky. The conveyor belt 16 consists of TEFLON* or silicon, for example, and rotates between a drive pulley 17, a small diameter pulley 18 and a tension pulley 19. The small diameter pulley 18 is disposed with an acute angle so that the conveyor belt 16 rotating these pulleys 17, 18 and 19 describes a substantially triangular shape. This is an essential condition for the label L attached to the conveyor belt 16 to be peeled off at the position of the reduced diameter pulley 18. Reference numerals 19, 19' represent a pair of opposed support rollers which are used in order to reliably place the cut label L on the conveyor belt 16.

*TEFLON is a trademark of E. I. Du Pont de Nemours & Co. for tetrafluoroethylene.

Reference numeral 21 represents the aforementioned heater. The heater is interposed between the driving pulley 17 and the reduced diameter pulley 18 and heats the back of the conveyor belt 16 travelling between them. Accordingly, the thermosensitive adhesive 11 of the label L is heated via the conveyor belt 16 that is heated by the heater 21.

Next, the present invention will be described stepwise operationally.

First, a paper label element 10 having predetermined displays thereon is rolled up and fitted to a rotary shaft 10*a*. The leading edge of the label element 10 is fed out to the position of the rollers 13, 13'. These feed rollers 13, 13' are then operated manually so as to feed out a predetermined length of the label element 10. The label element 10 is sequentially cut by the cutters 15, 15' and several labels L are placed on the conveyor belt 16 and are set in a state labelling can be done. Since the conveyor belt 16 is heated by the heater 21 disposed below the back of the conveyor belt 16 while it passes over the heater 21 between the driving pulley 17 and the small diameter pulley 18, the labels L receive sufficient heat to make the thermosensitive adhesive 11 tacky. Hence, the labels L attach to the conveyor belt 16. The leading label L is positioned at the reduced diameter pulley 18 on the conveyor belt 16.

Next, a conveyor belt 23, which is placed in the proximity of the present apparatus is driven to convey object articles to be labelled. When the detector 25 detects the presence of the object articles 24, it operates the conveyor belt 16 and feed rollers 13, 13'. As the conveyor belt 16 travels, the label L positioned adjacent to the reduced diameter pulley 18 projects straight in the travelling direction without being bent and peels off from the conveyor belt 16 due to the acute turn in the conveyor belt 16 around the reduced diameter pulley 18. Since the support roller 22 is disposed in front of the reduced diameter pulley 18, the label L that projects from the conveyor belt 16 is pushed against the object 24 to be labelled and is reliably bonded to it as the object article 24 advances.

During this labelling process, the feed rollers 13, 13' and the conveyor belt 16 operate and feed the next label element 10 while transferring the label L on the conveyor belt 16 to the lower end position thereof, close to the reduced diameter pulley 18. After detecting the feed of a predetermined length of the label element 10, the detector 14 stops the operation of the feed rollers 13, 13' and the conveyor belt 16, and the cutters 15, 15' cut the label element 10, thereafter entering the waiting state until the detector 25 detects the presence of the next object 24 to be labelled.

Labelling can be continuously effected as the above-mentioned procedures are sequentially repeated.

If a material having high peelability with respect to the adhesive such as TEFLON is used for the conveyor belt 16, the label can be easily peeled as in the conventional label using the tacky paper.

In the above-mentioned embodiment, the label element 10 is printed in advance. However, printing may be effected by disposing an arbitrary printer between the rotary shaft for supporting the roll of the label elements 10 and the feed rollers 13, 13'. In this embodiment, the heater 21 is interposed between the driving pulley 17 and the reduced diameter pulley 18 so as to reliably heat the label L on the conveyor belt 16. In continuously bonding the label L, however, another heating means may be used for heating the conveyor belt 16, deleting the heater 21. Besides the cutting system, the label element 10 may be punched out in an arbitrary shape.

As described above, in accordance with the present invention, the thermosensitive adhesive label is activated on the conveyor belt heated by the heater or the like while the label is being transferred by the conveyor, and after the label is made tacky, it is peeled off from the conveyor belt by means of the acute bend therein. Hence, no specific mechanism for sucking the thermosensitive adhesive label at the time of heating is necessary. Since no separation such as tacky paper is needed, the label itself can be produced at a lower production cost. As the thermosensitive adhesive label is placed on the belt conveyor and is heated via the conveyor belt, the label can be heated with a high level of heat efficiency. No additional space is necessary for the heater because it can be incorporated in the conveyor belt.

FIGS. 4 through 7 show another embodiment of the present invention.

Figure 1:
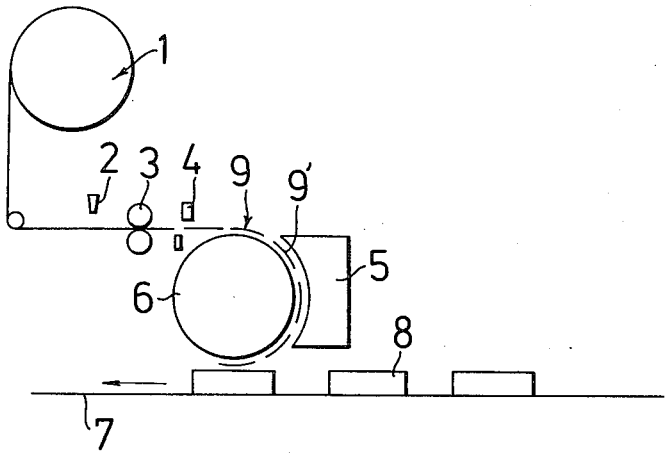
FIG. 1 is a schematic view illustrating apparatus for practicing the conventional labelling method.
Figure 4:
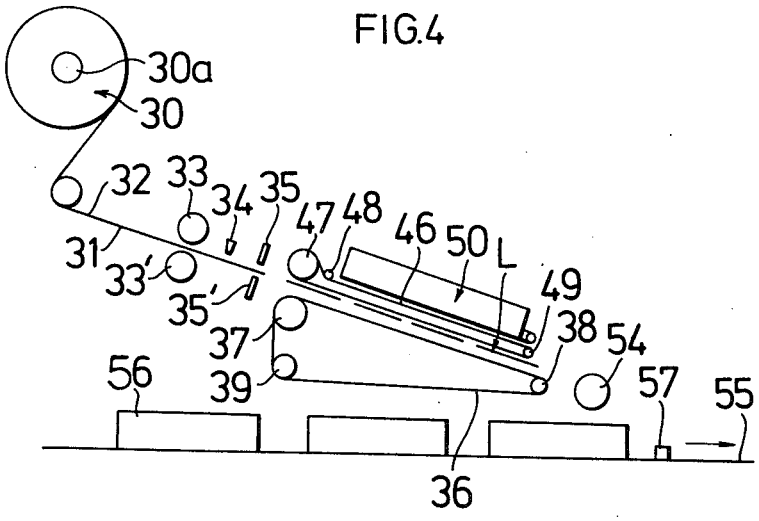
FIG. 4 is a schematic view illustrating a second embodiment of apparatus constructed in accordance with and embodying the present invention for bonding thermosensitive labels.

In FIG. 4, reference numeral 30 represents the label element, which is the same as the one indicated 10 in the above-described embodiment. In other words, the label element 30 has displays on its face 32 and the thermosensitive adhesive 31 on its back. Reference numerals 33, 33' represent opposed feed rollers; 34 is the detector; 35, 35' are the cooperating cutters; and 57 is the article detector. All these components have the same construction as the corresponding elements 10, 12, 11, 13, 13', 14, 15, 15' and 25, respectively, of the embodiment shown in FIGS. 1, 2 and 3.

Reference numeral 36 represents a heat-resistant transfer conveyor belt which travels below a hot air generator 50 which heats the back of the label L, develops its bonding function and peels the end of the label L after it becomes tacky. The conveyor belt 36 is made of TEFLON or silicon, for example, and rotates between the feed pulley 37, the small diameter pulley 38 and the drive pulley 39. The small diameter pulley 38 is disposed at an acute angle so that the conveyor belt 36 that rotates the feed pulley 37, the small diameter pulley 38, and the drive pulley 39 describes a substantially triangular shape. This is an essential condition for the label L attached to the conveyor belt 36 to peel therefrom at the position of the small diameter pulley 38. The feed pulley 37 opposes an upper feed pulley 47 and the same cooperate to reliably place the label L cut by the cutters 35, 35' onto the transfer conveyor belt 36. The rotary shafts **37*a*, 39*a* of the feed pulley 37 and drive pulley 39, respectively, (FIG. 7) are rotatably supported on frames 41, 42 by bearings 43 and the shaft 39*a* of the driving pulley 39 is connected to a drive source via a drive shaft 40**.

Reference numeral 46 represents a heat-resistant conveyor belt which confronts the above-mentioned transfer conveyor belt 36 and moves endlessly around the feed pulley 47 carried on rotary shaft **47*a*, a tension pulley 48 and a small diameter pulley 49. Conveyor belt 46 prevents the label L from being blown off by the hot air and the feed pulley 47, the tension pulley 48 and the small diameter pulley 49 are rotatably supported on frames 41, 42 by bearing 43. A gear 44 is fitted to the feed pulley 37 and cooperatively engages with a gear 45 that is operatively connected to the feed pulley 47**.

Figure 7:
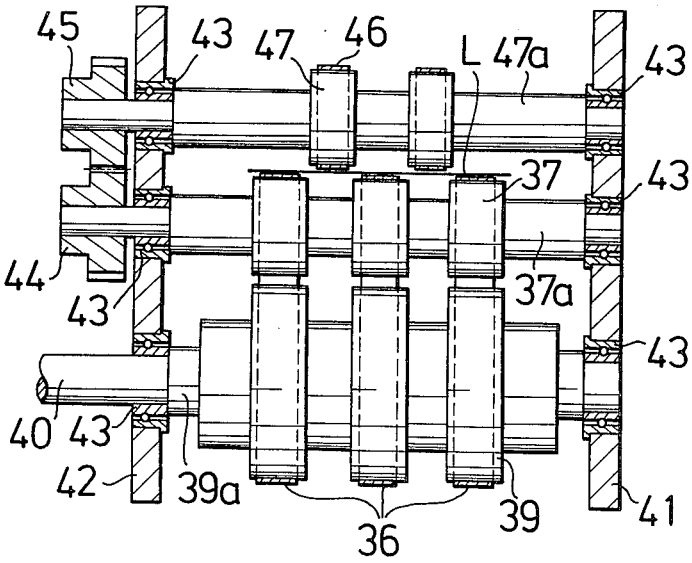
FIG. 7 is an enlarged fragmentary view, in partial section, illustrating the conveyor belt system shown in FIG. 5.

The phase of feed pulley 37 is offset from that of feed pulley 47 lest they should come into contact with each other. This arrangement is shown in FIG. 7, and prevents the transfer of adhesive attaching to the transfer conveyor belt 36, which is positioned above the feed pulley 37, to the upper conveyor belt 46. Accordingly, the label L does not attach to the upper conveyor belt 46 and hence, it is not transferred by it.

Figure 5:
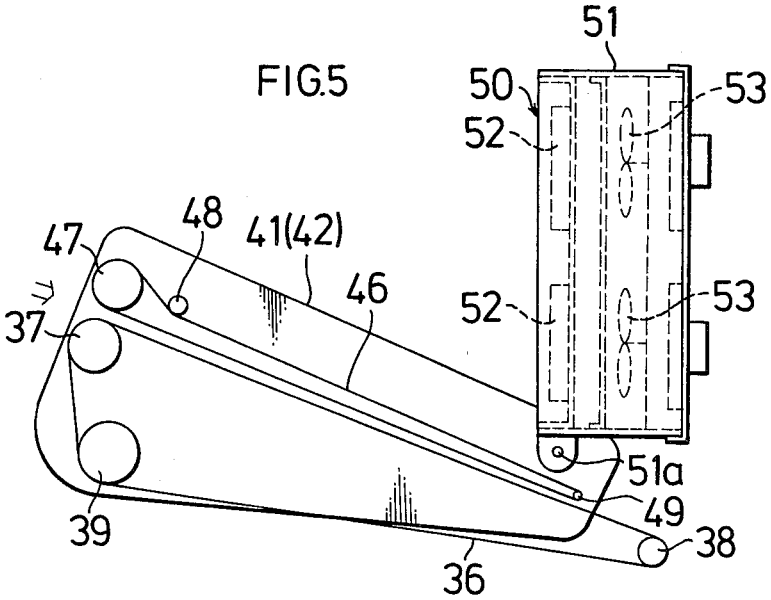
FIG. 5 is an enlarged fragmentary schematic view of the heater and associated conveyor belts shown in FIG. 4.
Figure 6:
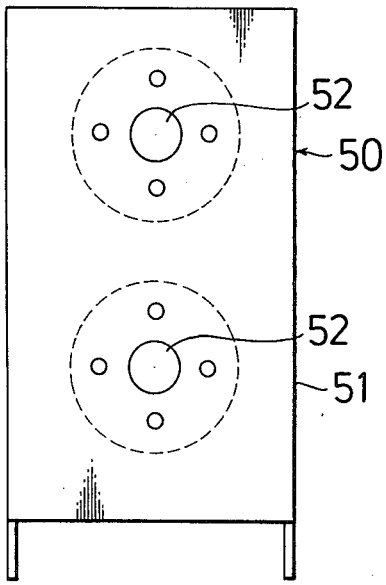
FIG. 6 is an elevational view of the heater as shown in FIG. 5.

Reference numeral 50 represents the hot air generator, whose case 51 is pivotably fitted to the frames 41, 42 by a pin **51*a*. When this device is used, it is inclined on the belt conveyor 46 as shown in FIG. 4, and can be raised upright for cleaning or the like, as shown in FIG. 5. An arbitrary number of honeycomb-like electronic heaters 52 and motor fans 53 are stored in the case 51 and the air fed by the motor fans 53 can be discharged as hot air. The heaters 52 and the fans 53 are connected to a detector or a timer so that they operate only when necessary, such as when a label L is fed to the transfer conveyor belt 36**.

The operation of the thermosensitive label bonding apparatus of this embodiment, illustrated generally in FIG. 4, will now be described.

Firstly, the roll of the paper label element 30 having the predetermined display is fitted to the rotary shaft **30*a* and the leading edge of the label element 30 is pulled out and led to the feed rollers 33, 33'. The feed rollers 33, 33' are then operated manually to feed out a predetermined length of the label element 30, which is sequentially cut by the cutters 35, 35'. Several labels L are placed on the transfer conveyor belt 36 and are set under the labelling condition. Since the transfer conveyor belt 36 is heated by the hot air generator 50 disposed above it and passes below the hot air generator 50 between the driving pulley 37 and the reduced diameter pulley 38, the labels L on the transfer conveyor belt 36 come into direct contact with the hot air and receives the heat from the transfer conveyor belt 36 to such an extent that the thermosensitive adhesive 31 becomes tacky and the label attaches to the transfer conveyor belt 36. The leading label L is positioned at the small diameter pulley 38 on the transfer conveyor belt 36**.

Next, another conveyor belt 55 disposed in the proximity of the present apparatus is rotated so as to transfer the object article 56 to be labelled. When the detector 57 detects the presence of the object article 56, it actuates the transfer conveyor belt 36 and feed rollers 33, 33'. As the transfer conveyor belt 36 rotates, the label L positioned in the proximity of the small diameter pulley 38 projects straight in the travelling direction without being bent owing to the acute bend in the transfer conveyor belt 36 around the reduced diameter pulley 38 and is peeled off from the transfer conveyor belt 36. Since the support roller 54 is disposed adjacent the reduced diameter pulley 38, the label L projecting from the transfer conveyor belt 36 is pushed onto the object article 56 to be labelled and is reliably labelled to the object article 56 as it moves.

During this labelling process, the feed rollers 33, 33' and the transfer conveyor belt 36 operate to feed out the next label element 30, and the label L on the transfer conveyor belt 36 is conveyed to the position on the conveyor belt close to the small diameter pulley 38. When it detects that a predetermined length of the label element 30 has been fed, the detector 34 stops driving the feed rollers 33, 33' and the transfer conveyor belt 36, causes the cutters 35, 35' to sever the label element 30, and thereafter is inactive until the other detector 57 detects the presence of the next article to be labelled.

Labelling can be continuously carried out as the above-mentioned procedures are sequentially repeated.

In this particular embodiment, the thermosensitive adhesive label is directly heated by hot air and is also heated on the transfer belt conveyor while being conveyed by it so as to develop its tackiness. The label is thereafter peeled off from the transfer conveyor belt by the acute bend in the belt. According to this arrangement, no specific mechanism such as a mechanism for sucking the thermosensitive adhesive label when it is heated is required, in particular. Moreover, the peelable separator such as the tack paper is not necessary, either, so that the label itself can be economically produced. Since the thermosensitive adhesive label to be placed on the transfer conveyor belt is heated via the conveyor belt, heating can be effected efficiently and since the hot air generator can be assembled on the transfer belt conveyor, no additional space is required, in particular. As the honeycomb-like electronic heater having a quick rise time is used as the hot air generator, the zone for heating the thermosensitive adhesive label can be instantaneously raised to temperature (e.g., about 170° C.) so that the working ratio can be improved and the power source can be turned off when the apparatus must be stopped temporarily such as when replacing the labels.

Figure 8:
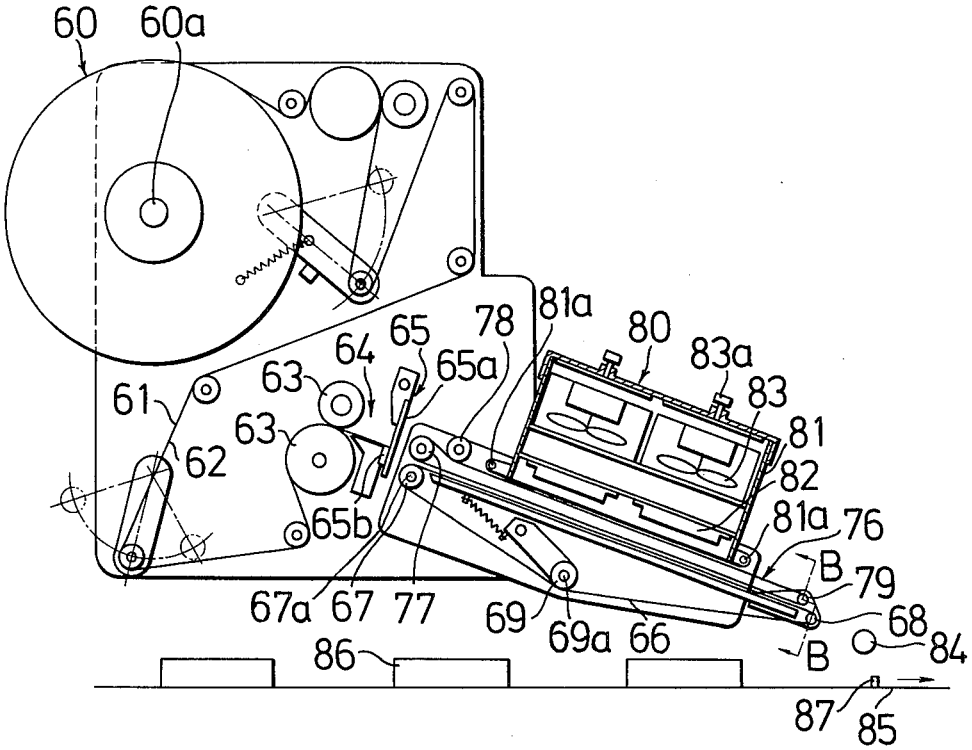
FIG. 8 is a schematic view of a further or third embodiment of apparatus constructed in accordance with and embodying the present invention for bonding a thermosensitive adhesive label.

FIGS. 8 through 11 show a further or third embodiment of the present invention. This embodiment has the same basic construction as the second embodiment described above in connection with FIGS. 4 through 7. In FIG. 8, reference numeral 60 represents the label element which corresponds to label 30. The label element 60 has the display 61 and the thermosensitive adhesive 62 on its two surfaces. Reference numerals 63, 63' represent the feed rollers; 64 is the detector; 65 is generally the cutter with 65*a* being the upper blade; and 65*b* being the lower blade. Reference numeral 66 represents the heat-resistant transfer conveyor belt which rotates around the drive pulley 67, the small diameter pulley 68 and the tension pulley 69. The small diameter pulley 68 is disposed at an acute angle in such a manner that the transfer conveyor belt 66 describes a substantially triangular shape. Reference numeral 76 represents a heat-resistant conveyor belt which confronts the transfer conveyor belt 66 and moves endlessly between feed pulley 77, tension pulley 78 and small diameter pulley 79.

Reference numeral 80 represents the hot air generator whose case 81 is fixed to the frames 71, 72 by bolts and nuts 81*a*. When used, it is positioned on the belt conveyor 76 as shown in FIG. 8 and can be arbitrarily removed whenever necessary such as for cleaning. The case 81 contains an arbitrary number of honeycomb-like electronic heaters 82 and motor fans 83 and can supply the air fed from the motor fans 83 as hot air. The electronic heaters 82 and the motor fans 83 are connected to the detector or the timer so that they are operate when the label L is supplied to the transfer conveyor belt 66. That is to say, they only operate when necessary. Reference numeral 83*a* represents a knob for adjusting the quantity of air. Reference numeral 84 indicates a support roller 22; 85 represents an object article conveyor belt; 86 represents object articles to be labelled and 87 indicates a detector which latter correspond to the elements indicated at 22, 23, 24 and 25, respectively, of the initial form of the present invention above described, being structurally and functionally identical therewith.

This embodiment, being generally illustrated in FIG. 8, is substantially the same as the embodiment shown in FIGS. 4 through 7 except that the construction of the hot air generator and heat-resistant conveyor belt in the latter are slightly modified. Hence, this particular embodiment provides the same actions and effects as those of the embodiment illustrated in FIGS. 4 through 7, inclusive.

Figure 9:
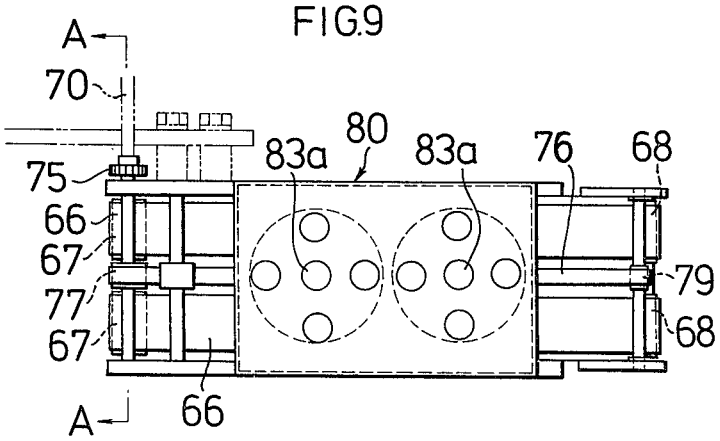
FIG. 9 is a fragmentary enlarged top plan view of the hot air generator and conveyor belts shown in FIG. 8.
Figure 11:
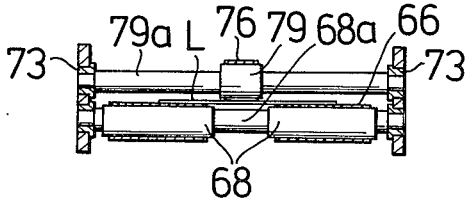
FIG. 11 is a vertical transverse sectional view taken along the line B—B of FIG. 9.

The conveyor belt portion which is different from that of the preceding embodiment will now be explained. As shown in FIGS. 9 through 11, the number of pulleys is reduced by one and the drive shaft 70 is directly connected to the shaft of the drive pulley 77. The shafts 67*a* and 69*a* of the drive pulleys 67 and 69, respectively, (which also function as the drive shafts in this embodiment) are rotatably supported on the frames 71 and 72. Drive shaft 70 is connected to a drive source. The feed pulley 77, the tension pulley 78 and the small diameter pulley 79 are rotatably supported on the frames 71, 72 by bearings 73. The gear 75 is engaged to the feed pulley shaft 77*a* and meshes with the gear 74; said latter being carried on drive pulley shaft 67*a*.

However, the arrangement shown in FIGS. 9 through 11 is merely illustrative and can be of course modified in an arbitrary manner so long as no problem develops in designing the apparatus.

Though the hot air generator 80 is fixed by means of nuts and bolts 81*a* in this embodiment, it may be supported or suspended by a suitable stand or the like in the same arrangement as shown in FIG. 8.

Figure 12:
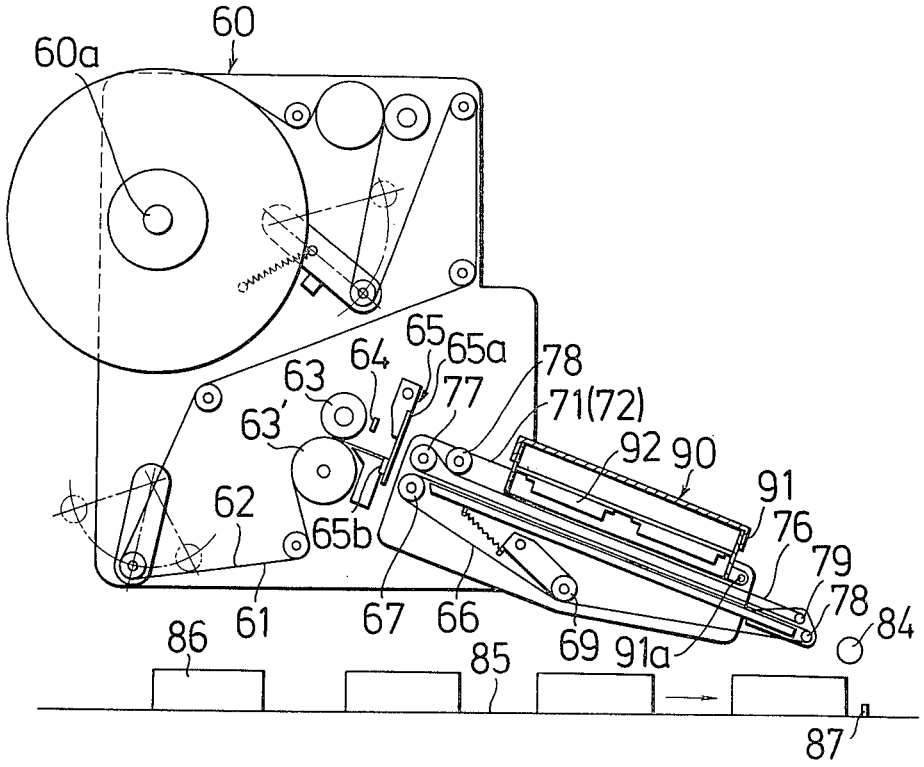
FIG. 12 is a schematic view of a still further or fourth embodiment of apparatus constructed in accordance with and embodying the present invention for bonding a thermosensitive adhesive label.

FIG. 12 shows a still further or fourth embodiment of the present invention in which the hot air generator of the second embodiment (as shown in FIGS. 4–7, inclusive) is changed to a heating unit 90 equipped with heaters 92.

Heating unit 90 in this last or fourth embodiment is pivoted on pins 91*a* but may be fixed by nuts and bolts in the same way as in the third embodiment (as shown generally in FIGS. 8, 9, 10 and 11) or may be supported or suspended by a suitable stand or the like.

What is claimed is:

1. A method of labelling by use of a thermosensitive adhesive label equipped on the back thereof with a thermosensitive adhesive exhibiting tackiness upon heating and having no separate backing, said method comprising the steps of: placing said thermosensitive adhesive label on a heat-resistant conveyor belt; conveying said thermosensitive adhesive label while heating said thermosensitive adhesive so that said adhesive develops its tackiness; directing the path of said label by means of said heat-resistive conveyor belt so that said path approaches the path of a moving object article to be labelled in converging relationship; peeling said thermosensitive adhesive label from said heat-resistant conveyor belt by acutely bending said heat-resistant conveyor belt at a point proximate to a point of convergence of the path of said label with the path of said object article; and bonding said thermosensitive label to said object article whereby said object article is caused to be labelled.

2. A method according to claim 1 and further comprising moving said object article to be labelled by further conveyor belt causing the path of said object article to define an acute angle with respect to the path of said label, and wherein the step of acutely bending said heat-resistant conveyor belt is effected by bending a linearly-extending reach of said heat-resistant conveyor belt back around a small radius within said acute angle along a reach of said further conveyor belt linearly approaching said point of convergence.

3. A method of labelling according to claim 1 wherein the step of heating said thermosensitive adhesive is effected by heating said heat-resistant conveyor belt from the side opposite from that carrying said label.

4. A method of labelling according to claim 1 wherein the step of heating said thermosensitive adhesive is effected by heating said label by heat directed toward said heat-resistant conveyor belt from the side carrying said label.

5. A method of labelling according to claim 4 wherein the step of heating said thermosensitive adhesive is effected by heating said label and said heat resistant conveyor belt by directing hot air toward said label and said heat-resistant conveyor belt.

6. In apparatus for bonding a thermosensitive adhesive label to an object article to be labelled, said label carrying on the back side thermosensitive adhesive exhibiting tackiness upon heating thereof and having no separate backing, said apparatus including a heat-resistant conveyor belt for carrying said label along a first path and a further conveyor belt for carrying said object along a second path, said paths converging, means for heating said label while being carried along said first path, the improvement characterized by means for causing said heat-resistant conveyor belt to define an acute bend at a point proximate the convengence of said first path with said second path, said acute bend being sufficient for causing said label to be stripped from said heat-resistant conveyor belt for being transferred to said object article.

7. In apparatus according to claim 6, the improvement further characterized by said means for causing said heat-resistant conveyor belt to define an acute bend comprising a roller of small radius proximate the convergence of said first path with said second path, around which said heat-resistant conveyor passes.

8. In apparatus according to claim 7, the improvement further characterized by said further conveyor belt defining a reach approaching said point of convergence, said heat-resistant conveyor belt defining a first reach approaching said point of convergence for carrying said label over said roller and a second reach retreating from said roller but spaced from the reach of said further conveyor belt, said roller being of a diameter for causing said label to be stripped from said heat-resistant conveyor belt as said heat-resistant conveyor belt passes around said roller.

9. In apparatus according to claim 8, the improvement further characterized by said first and second reaches of said heat-resistant conveyor belt defining between them an acute angle.

10. In apparatus according to claim 6, the improvement further characterized by said means for heating said label comprising a heater for heating said heat-resistant conveyor belt from the side opposite from that carrying said label.

11. In apparatus according to claim 6, the improvement further characterized by said means for heating said label comprising a heater for heating said label and said heat-resistant conveyor belt from side carrying said label.

12. In apparatus according to claim 11, the improvement further characterized by said heater comprising a hot air generator including a heating element and a fan for directing air across said heating element.

13. In apparatus according to claim 12, the improvement further characterized by said heater being detachably fitted to a position proximate said first reach.

14. In apparatus according to claim 13, the improvement further characterized by said heater being pivotally affixed for rotation in and out of a position overlying and proximate of said first reach.

15. In apparatus according to claim 14, the improvement further characterized by and further comprising a second heat-resistant conveyor belt moving in direction opposite to the first said heat-resistive conveyor belt for carrying said label between said first and further heat-resistive conveyor belts, said further heat-resistive conveyor belt being located between said heater and said first reach and being of a character for permitting hot air to be directed toward said label and said first reach.

* * * * *